US007832603B2

(12) United States Patent
Gouldson

(10) Patent No.: US 7,832,603 B2
(45) Date of Patent: Nov. 16, 2010

(54) TWO PIECE DESIGN FOR COORDINATE LOOP HANGER

(76) Inventor: Stanley Gouldson, 10 Harbour Point Dr., Northport, NY (US) 11768

( * ) Notice: Subject to any disclaimer, the term of this patent is extended or adjusted under 35 U.S.C. 154(b) by 115 days.

(21) Appl. No.: 11/391,143

(22) Filed: Mar. 28, 2006

(65) Prior Publication Data

US 2006/0278671 A1 Dec. 14, 2006

Related U.S. Application Data

(60) Provisional application No. 60/666,988, filed on Mar. 31, 2005.

(51) Int. Cl.
*A41D 27/22* (2006.01)

(52) U.S. Cl. ..... 223/88; 223/85; 223/96

(58) Field of Classification Search ..... 223/85, 223/88, 90–93, 95, 96; D6/328
See application file for complete search history.

(56) References Cited

U.S. PATENT DOCUMENTS

| | | | | | |
|---|---|---|---|---|---|
| 924,763 | A | * | 6/1909 | Grant | 223/88 |
| 2,113,394 | A | | 4/1938 | Biri et al. | |
| 2,391,661 | A | * | 12/1945 | Watkins et al. | 223/88 |
| 2,804,245 | A | * | 8/1957 | Biondolillo et al. | 223/90 |
| 2,822,967 | A | * | 2/1958 | Spitz | 223/88 |
| 2,876,939 | A | | 3/1959 | Kenney | |
| 3,165,245 | A | * | 1/1965 | Levine et al. | 223/91 |
| 3,225,978 | A | | 12/1965 | Wach | |
| 3,307,753 | A | * | 3/1967 | Levine et al. | 223/95 |
| D234,243 | S | * | 2/1975 | Lindemann | D6/328 |
| 3,963,154 | A | * | 6/1976 | Schwartz et al. | 223/85 |
| 4,363,430 | A | | 12/1982 | Radlin | |
| 4,438,874 | A | * | 3/1984 | Zuckerman et al. | 223/88 |
| 4,653,678 | A | * | 3/1987 | Blanchard et al. | 223/85 |
| 5,029,739 | A | * | 7/1991 | Blanchard et al. | 223/88 |
| 5,417,352 | A | * | 5/1995 | Jen | 223/85 |
| 5,480,075 | A | * | 1/1996 | Robinson | 223/88 |
| 5,573,151 | A | * | 11/1996 | Fildan | 223/96 |
| 5,577,644 | A | * | 11/1996 | Chen | 223/85 |
| 5,595,386 | A | | 1/1997 | Parsons | |
| 5,603,438 | A | * | 2/1997 | Jugan | 223/89 |
| 5,613,630 | A | * | 3/1997 | Isenga et al. | 223/88 |
| 6,244,478 | B1 | * | 6/2001 | Lee | 223/90 |
| 6,454,145 | B1 | * | 9/2002 | Russ | 223/85 |
| 6,688,502 | B2 | * | 2/2004 | Kunreuther | 223/85 |
| 7,182,232 | B2 | * | 2/2007 | Fleming et al. | 223/88 |
| 7,404,502 | B2 | | 7/2008 | Ho et al. | |
| 2005/0284899 | A1 | * | 12/2005 | Fleming et al. | 223/85 |
| 2007/0199964 | A1 | * | 8/2007 | Gouldson | 223/91 |
| 2007/0199965 | A1 | * | 8/2007 | Gouldson | 223/91 |

FOREIGN PATENT DOCUMENTS

| | | |
|---|---|---|
| DE | 26 53 971 A1 | 6/1978 |

(Continued)

*Primary Examiner*—Gary L Welch
*Assistant Examiner*—Nathan E Durham
(74) *Attorney, Agent, or Firm*—Scully, Scott, Murphy & Presser, P.C.

(57) ABSTRACT

The present invention is directed to the field of garment hangers, in particular, garment hangers for retaining and supporting lower body garments. Such hangers may be referred to as coordinate loop hangers, which coordinate loop hangers may be supported by upper garment hangers.

8 Claims, 4 Drawing Sheets

FOREIGN PATENT DOCUMENTS

| | | | |
|---|---|---|---|
| DE | 87 11 324.4 | | 12/1987 |
| DE | 92 12 412 | U1 | 11/1992 |
| DE | 42 31 126 | A1 | 3/1994 |
| FR | 2636315 | | 3/1990 |
| GB | 10798 | | 2/1912 |
| GB | 759905 | | 10/1956 |
| GB | 2 191 393 | A | 12/1987 |
| GB | 2217980 | A | * 11/1989 |
| GB | 2 223 400 | A | 4/1990 |
| GB | 2 350 058 | A | 11/2000 |
| GB | 2 413 071 | A | 10/2005 |
| JP | 3-58175 | | 3/1991 |
| JP | 8-66292 | | 3/1996 |
| JP | 10-33893 | | 2/1998 |
| JP | 10-179366 | | 7/1998 |

* cited by examiner

TWO PIECE DESIGN FOR COORDINATE LOOP HANGER

CROSS-REFERENCE TO RELATED APPLICATIONS

This application claims priority under 35 U.S.C. §119(e) of U.S. Provisional Patent Application Ser. No. 60/666,988, filed 31 Mar. 2005 by the present inventor and commonly assigned with the present application. The compete disclosure of the foregoing application is hereby incorporated by its reference for all purposes.

FIELD OF THE INVENTION

The present invention is directed to the field of garment hangers, in particular, garment hangers for retaining and supporting lower body garments. Such hangers may be referred to as coordinate loop hangers, which coordinate loop hangers may be supported by upper garment hangers.

BACKGROUND OF THE INVENTION

Many garments are designed for sale as matching outfits or sets. For example, a jacket and pant set, a jacket and top set, a short and top set, and other such combinations may be specifically manufactured to be sold as sets. In the sale of such garment sets, the seller desires to display these garments in a manner that makes it apparent that the garments are to be purchased together. Thus, separate garments may be hung on separate hangers and displayed alongside or next to each other, or the garments may be hung on a single hanger. The drawbacks in such display methods are that in the first example some frame or support is required to display the garments together, and in the second example sharing a hanger may obscure one of the individual garments that make up the coordinate garment set.

A benefit of displaying garment sets together is that the necessary display space can be significantly reduced. A further benefit of displaying such coordinate items together is to make it easier for the consumer to find and purchase such garments. It should further be recognized that the benefit of storing garments together may also extend to the transport and storage of such garments, in that such garment sets can be prepared for display prior to shipping to the point of sale, that is, the garments can be packaged onto their hanger sets prior to shipping to the point of sale as with typical garment on hanger ("GOH") programs.

Moreover, in many cases, each separate garment requires a hanger of a different type, such as a hanger suitable for displaying a blouse used with a hanger capable of supporting a skirt or a pair of slacks. Hanger structures, in which two hangers are ganged together, that is, with one hanger suspended from the other, may be employed for this application. With such hangers, the attaching structure may be temporarily or permanently connected to a supporting hanger.

Hanger manufacturers have developed a number of different hangers for supporting lower body garments, many of which are provided with clamps having jaws movable from an open position to closed position, with means being provided to maintain the clamps in a closed position. Such hangers may be adapted to be suspended from a bar on a rack or other suspending member, such as an open loop, or other means such as a closed loop that allow the hanger to be ganged over a suspending means while safeguarding against the displacement of the lower garment hanger. The closed loop may be affixed to the body of the lower garment hanger by means of an intermediate member, which may or may not be integral with the hanger body and loop.

Sometimes, a lower body hanger is combined with an upper garment hanger to display a suit or other set of articles. Since lower body garments come in a wide variety of sizes, lower body garment hangers are provided in a variety of lengths so that the proper hanger size can be matched to the appropriate garment size. Likewise, the ganging member of the lower body hanger may also come in a variety of lengths. It would be advantageous if a hanger system were available to allow the displayer, retailer and/or packager of garments to vary the size of the lower garment hanger and/or the ganging member. Further, to insure the integrity of the hanger system, it would be advantageous if the hanger system were provided with a mechanism that maintains the loop portion of the hanger and the hanger body itself in a locked condition to insure that the components remain fixed during all phases of transport, display, and sale of the garments. Such a system would allow person to select the components of the hangers from a variety of sizes and lengths.

SUMMARY OF THE INVENTION

In one aspect, the present invention is directed to a coordinate loop hanger system intended to be suspended from a garment hanger, which itself can support an upper body garment (hereinafter an "upper body garment hanger"), the coordinate loop hanger system comprising:

a ganging element comprising a member of preselected length affixed to an element for engaging an upper garment hanger, the member provided with an end distal to the loop, the distal end having a first mating profile;

a hanger body having at least one clamp for receiving an article of clothing, such as a lower body article of clothing, within jaws of the clamp, the hanger body provided with a second mating profile, wherein the first mating profile of the ganging element is complementary to and engageable with the second mating profile and vice versa, and wherein, the first mating profile is provided with an anti-disassociator located to abut a surface of the second mating profile when the first and second mating profiles are engaged, and wherein, when the first and second mating profiles are engaged, the anti-disassociator is located in a disassociation-resisting position to resist disassociation of the first and second mating profiles.

As used in this paper, the term "anti-disassociator" refers to a component that, alone or in combination with another component, provides a measure of resistance to the dissociation of the components of the coordinate loop hanger system of the present invention. However, the meaning of the term "anti-disassociator" does not encompass adhesives, which are explicitly excluded from the meaning of this term.

In one aspect, the coordinate loop garment hanger is suspended from an upper body garment hanger by placing the loop of the ganging element over the hook or suspension member of the upper body garment hanger, with the elongated member depending downward from the loop in a substantially vertical direction. The hanger body of the coordinate loop garment hanger, when engaged with the elongated member, extends in a substantially horizontal direction. With this arrangement, a coordinated or matched set of garments can be displayed together. The upper garment hanger can display a jacket, blouse, or other garment, and the bottom hanger can display slacks, skirts, or some other garment.

In an another aspect, the present invention is directed to a coordinate loop hanger system which is constructed for suspension from a garment hanger that can support an upper body garment, the coordinate loop hanger system comprising:

a ganging member comprising an elongated member of preselected length affixed to a loop, the member provided with an end distal to the loop, the end having a first mating profile;

a hanger body having at least one clamp for receiving an article of clothing, such as a lower body article of clothing within jaws of the clamp, the hanger body provided with a second mating profile, wherein the first mating profile is complementary to and engageable with the second mating profile and vice versa, and wherein, the second mating profile is provided with an anti-disassociator located to abut a surface of the first mating profile when the first and second mating profiles are engaged, and wherein, when the first and second mating profiles are engaged, the anti-disassociator is located in a disassociation-resisting position to resist disassociation of the first and second mating profiles.

In a specific aspect of the invention, the element for engaging the upper garment hanger that is provided on the ganging member is dimensioned to fit over the hook of an upper garment hanger, which permits suspension of the coordinate loop hanger system, with the hanger body of the coordinate loop hanger system suspended at a height lower than the upper body garment hanger. The element may, for example, be a loop, such as an open loop or alternatively a closed loop. It may also be a bar or other element providing a surface from which the ganging element can be suspended.

In another specific aspect of the invention, the hanger body of the coordinate loop hanger system is provided with a first and second clamp, each of which are located, respectively, at or near first and second ends of the hanger body. The clamps are suitable for retaining a garment within their grasp, such as an article of clothing, and especially an article of lower body clothing (e.g., pants, skirt, trousers, bathing suit, etc.).

In a more specific aspect of the invention, the first mating profile and second mating profile are a plug and socket (or vice versa). The plug is sized and dimensioned to be received within the socket. The plug and socket can be located interchangeably between the hanger body and ganging element. The skilled artisan would recognize, however, various embodiments to establish secured engagement between the hanger body and the ganging element.

In yet a more specific aspect of the invention, the first mating profile of the ganging element is a plug. Even more specifically, the hanger body is provided with a projection extending from the hanger body, which projection is provided with a socket-defining extension, which acts as the second mating profile.

In another specific embodiment, one of the first mating profile and second mating profile is provided with an anti-disassociator which is configured as a tab located to abut a surface of the opposite mating profile when the first and second mating profiles are engaged, and wherein, when the first and second mating profiles are engaged, the anti-disassociator is located in a disassociation-resisting position to resist disassociation of the first and second mating profiles.

DETAILED DESCRIPTION OF THE INVENTION

Figure 1:
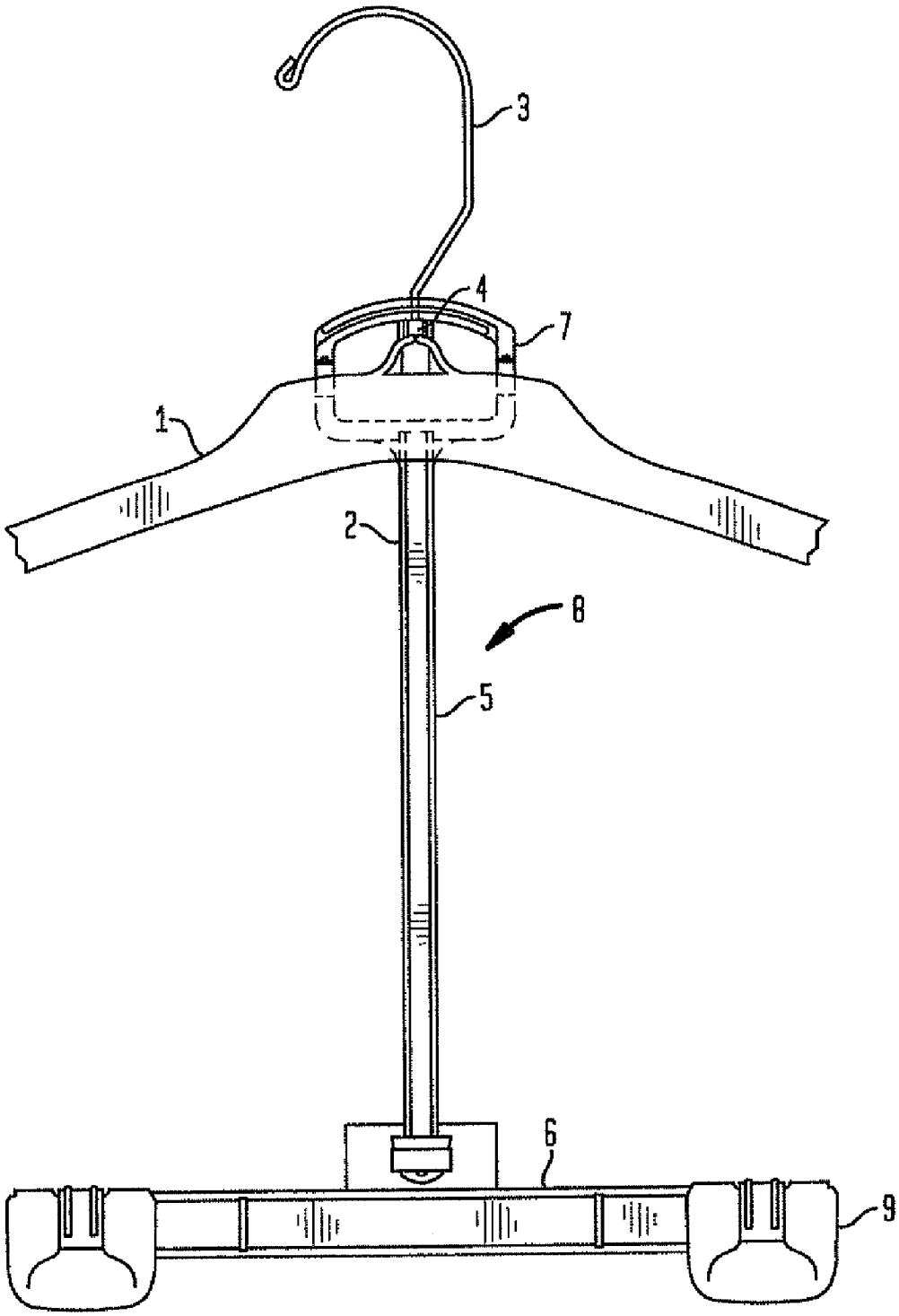
FIG. 1 is a perspective view of a coordinate loop hanger system of the present invention suspended from an upper body garment hanger.

FIG. 1 depicts an embodiment of the present invention wherein the coordinate loop hanger 2 is suspended from the upper hanger 1. Upper hanger 1 exemplifies a particular style of upper garment hanger employing a metal hook 3, although other hanger styles, such as those having a plastic hook can be employed here as well. Coordinate loop hanger 2 includes ganging member 8 comprising loop 7 (shown here placed over hook 3 and resting on boss 4 of the upper hanger 1), an elongated member 5 attached to the loop 7. Hanger body 6 is provided with clamps 9 for retaining a garment within the jaws of the clamps. The clamps can be of any design known in this field of endeavor, and at least a portion of the clamps may be formed integral with the hanger body.

It should be observed that when the lower hanger 2 is suspended from the upper garment hanger 1, the upper garment hanger 1 can retain an upper body garment, such as a jacket, and the lower hanger 2 can retain a lower body garment, such as pants or slacks.

Figure 2:
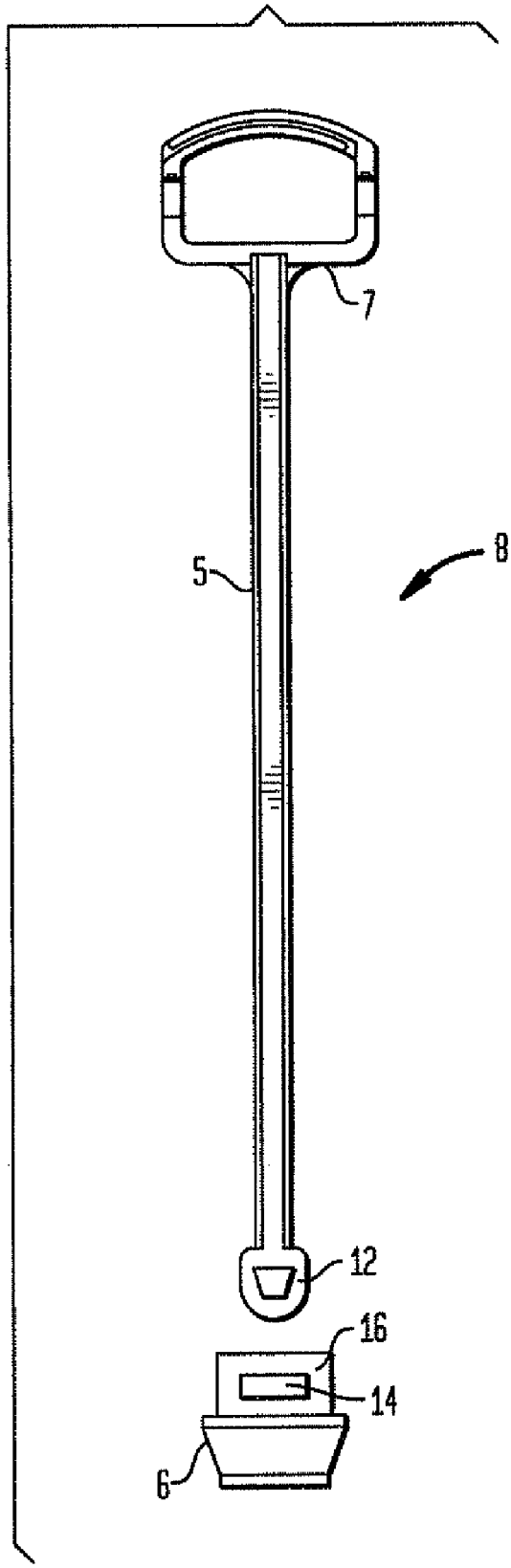
FIG. 2 is an exploded view of a specific embodiment of the coordinate loop hanger system of the present invention.

FIG. 2 depicts an embodiment of the present invention wherein the ganging member 8, comprising the loop 7 and elongated member 5, is disengaged from the second hanger body component 6. The end of the ganging member 8 that is distal to loop 7 is provided with plug 12, which is sized and dimensioned to engage in socket 14 provided on the hanger body 6. Socket 14 is positioned on socket support 16, which extends from the hanger body 6.

Figure 3:
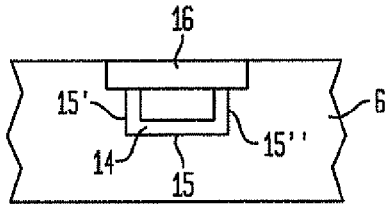
FIG. 3 is a top plan view of a specific embodiment of the present invention.
Figure 4:
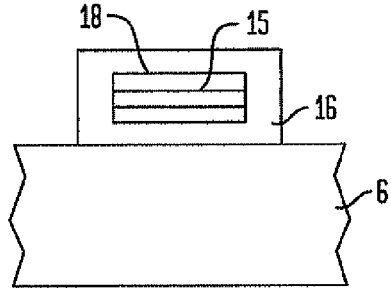
FIG. 4 is a perspective view of a specific embodiment of the present invention.

FIG. 3 shows an embodiment wherein the hanger body 6, as viewed from the top thereof, with socket support 16 extending upward therefrom. Socket 14, with its sidewalls 15, 15', and 15" defines the space for receiving the plug 12 on first component 10. FIG. 4 shows an alternative embodiment of the socket support 16 in which the socket support 16 is provided with an opening 18. The laterally extending sidewall 15 of socket 14 is visible through the opening.

Figure 5:
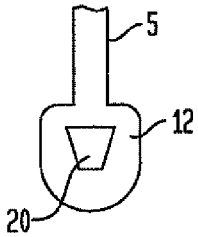
FIG. 5 is a top plan view of an aspect of a specific embodiment of the present invention.
Figure 6:
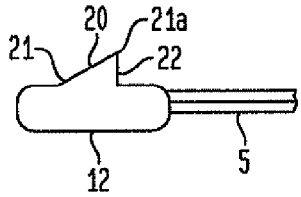
FIG. 6 is a cross sectional view of the plug depicted in FIG. 5.

FIGS. 5 and 6 show plug 12 and distal end of elongated body 5. Tab 20, positioned on plug 12, extends out of the plane of the plug. Tab 20 is provided with sloping surface 21 rising to apex 21*a*, from which point the tab is provided with a locking surface 22 that is substantially perpendicular to the axis of the elongated body 5.

Figure 7:
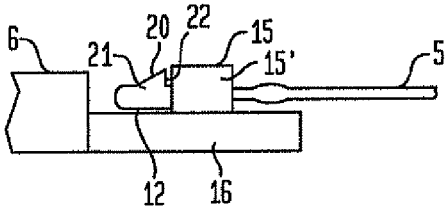
FIG. 7 is a cross sectional view of a first plug and socket arrangement of the present invention.

FIG. 7 shows the plug 12 at distal end of elongated member 5 engaged within a socket positioned on the support 16 that is shown in FIG. 3. As can be seen there, the sloping surface 21 of tab 20 is sized and shaped to facilitate the passing of tab 20 into the socket. The locking surface 22 of the tab 20 is sized to that at least a portion of the locking surface 22 will abut a surface on sidewall 15 on the socket, and thereby provide resistance against the separation of the hanger body 6 and elongated member 5 if a force is applied that could separate the two. In one aspect of the present invention, the locking surface 22 of the tab 20 and the sidewall 15 of the socket are each sized and dimensioned to not entirely prohibit separation of the elongated member and hanger body 6, but instead allow separation of the two components upon application of a relatively high level of force, thereby effectively prohibiting inadvertent separation of the two components, while allowing for intentional separation of the two components when a sufficient force is applied.

Figure 8:
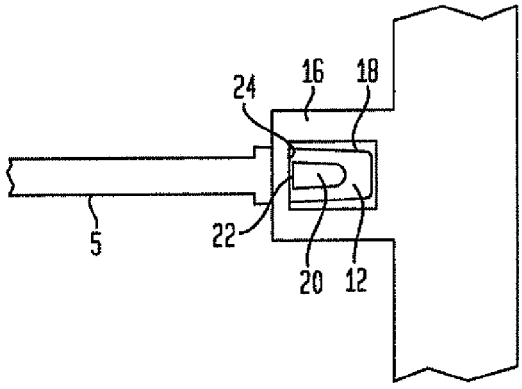
FIG. 8 is a cross sectional view of a second plug and socket arrangement of the present invention.

FIG. 8 shows the plug 12 at distal end of elongated member 5 engaged within the socket support 16 depicted in FIG. 4. In this embodiment, tab 20 of plug 12 resides within the opening 18 on the rear side of socket support, with locking surface 22 abutting against an inner wall 24 of the opening 18 in the socket support 16.

The hanger of the present invention can be molded out of conventional thermoplastic materials via injection molding techniques known of a person of ordinary skill in the art. Certainly such materials known in the art provide desirable levels of flexibility and resiliency that provide resistance to disassociation between the ganging member 8 and hanger body 6.

Figure 9:
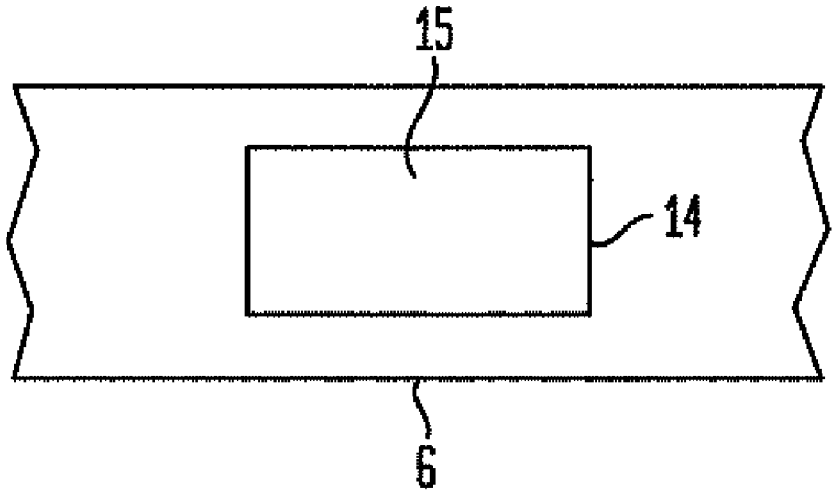
FIG. 9 is an elevational view of a first socket arrangement of the present invention.
Figure 10:
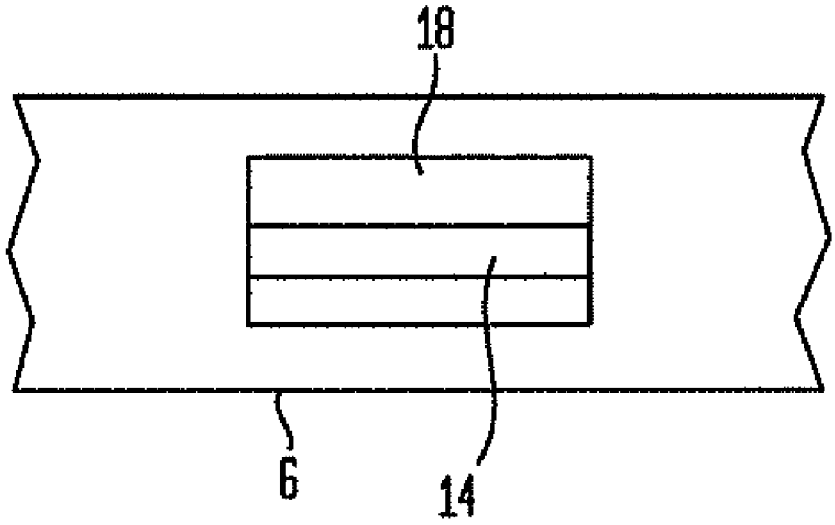
FIG. 10 is an elevational view of a second socket arrangement of the present invention.

FIG. 9 is an alternative embodiment, which eliminates the socket support by positioning the socket 14 on a side of the hanger body 6. FIG. 10 is yet another embodiment in which the hanger body is provided with and opening through which socket 14 is visible.

While the foregoing written description and associated figures have the plug positioned on ganging member 8 and the mating socket provided on hanger body 6, it should be readily understood that the plug and socket locations can be reversed among the ganging member and hanger body.

It should be appreciated that because the coordinate loop garment hanger of the present invention are assembled with a separate, the hanger body 6 and a separate ganging member 8, the person using the hangers of the present invention is free to select among a variety of different hanger body sizes and ganging member sizes. For example, lower body hangers are available in lengths including 8", 10", and 12". Thus, the user of the present invention can assemble the coordinate loop hanger system at the time the garments are placed on the hangers, making the appropriate selection of hanger sizes for both top and bottom garments. Likewise, the person can vary the ganging member length, which, at the least, allows control over the aesthetics of garment presentation when displayed. Furthermore, after use, the hangers can be disassembled with application of a force above the threshold necessary to overcome the disassociation-resisting capabilities of the anti-disassociator element.

What is claimed is:

1. A hanger system comprising:

a top hanger having a hanger supporting means;

a ganging element comprising an elongated member, a top hanger engagement means disposed at a top end of the elongated member for engaging the hanger supporting means of the top hanger, and a first mating profile disposed at a bottom end of the elongated member; and a bottom hanger having a body provided with at least one clamp for receiving an article of clothing within the clamp, the hanger body comprising a second mating profile, the second mating profile being releasably engageable with the first mating profile of the ganging member;

wherein the first mating profile comprises at least one of two complementary male or female mating parts and the second mating profile comprises at least the other one of two complementary male or female mating parts, the male mating part comprising a snap lock having a substantially horizontal locking surface, the female mating part comprising a complementary locking surface, wherein the female mating part further comprises a support extending upwardly from the hanger body of the bottom hanger or extending downwardly from the bottom end of the elongated member, a pair of sidewalls extending from the support and a middle wall connecting the sidewalls, for defining a space into which the snap lock is received, wherein the support comprises a through opening substantially opposite the middle wall of the support, the through opening comprising an inner surface which defines the complementary the horizontal locking surface of the snap lock, and wherein, when the first mating profile releasably engages the second mating profile, the horizontal locking surface of the snap lock interferes with the complementary locking surface in a disassociating resisting manner.

2. The hanger system of claim 1, wherein the ganging element, engagement means, and first mating profile are unitarily molded.

3. The hanger system of claim 1, wherein the bottom hanger comprises at least one clamp for retaining a garment, and wherein the clamp, the body and the second mating profile of the bottom hanger are unitarily molded.

4. The hanger system of claim 1, wherein the engagement means comprises a closed loop.

5. The hanger system of claim 1, wherein the engagement means comprises an open loop.

6. The hanger system of claim 1, wherein the sidewalls and the middle wall each comprises a bottom surface, and wherein at least one of the bottom surfaces constitutes the complementary locking surface for interfering with the horizontal locking surface of the snap lock.

7. The hanger system of claim 1, wherein the through opening permits visibility of the sidewalls and the middle wall of the female mating part.

8. The hanger system of claim 1, wherein the snap lock further comprises a sloped surface for facilitating the insertion of the snap lock into the female mating part.

* * * * *